US006280543B1

(12) United States Patent
Zonker et al.

(10) Patent No.: US 6,280,543 B1
(45) Date of Patent: Aug. 28, 2001

(54) PROCESS AND PRODUCTS FOR THE CONTINUOUS CASTING OF FLAT ROLLED SHEET

(75) Inventors: Harry R. Zonker, Pittsburgh; Stephen F. Baumann, Lancaster; Robert E. Sanders, New Kensington, all of PA (US); W. Bryan Steverson, Maryville, TN (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/010,160

(22) Filed: Jan. 21, 1998

(51) Int. Cl.[7] ..... C22F 1/04
(52) U.S. Cl. ..... 148/551; 148/552
(58) Field of Search ..... 148/551, 552, 148/415, 417, 439, 440; 420/534, 546

(56) References Cited

U.S. PATENT DOCUMENTS

| | | | | |
|---|---|---|---|---|
| 4,235,646 | | 11/1980 | Neufeld et al. | 148/551 |
| 4,318,755 | * | 3/1982 | Jeffrey et al. | 148/439 |
| 4,517,034 | | 5/1985 | Merchant et al. | 148/439 |
| 4,976,790 | | 12/1990 | McAuliffe et al. | 148/551 |
| 5,106,429 | | 4/1992 | McAuliffe et al. | 148/551 |
| 5,470,405 | | 11/1995 | Wyatt-Mair et al. | 148/551 |
| 5,496,423 | | 3/1996 | Wyatt-Mair et al. | 148/551 |
| 5,514,228 | | 5/1996 | Wyatt-Mair et al. | 148/551 |
| 5,516,382 | * | 5/1996 | Raynaud | 148/439 |
| 5,525,169 | * | 6/1996 | Murtha | 420/546 |
| 5,582,660 | * | 12/1996 | Erickson et al. | 420/546 |
| 5,634,991 | | 6/1997 | Kamat | 148/551 |
| 5,681,405 | * | 10/1997 | Newton et al. | 148/551 |
| 5,746,847 | * | 5/1998 | Tanaka et al. | 148/417 |

* cited by examiner

*Primary Examiner*—George Wyszomierski
(74) *Attorney, Agent, or Firm*—Charles Q. Buckwalter

(57) ABSTRACT

The invention hereof is directed to a continuous casting of flat rolled sheets selected from automotive sheet, can body sheet, and endstock which exhibits properties comparable to the same products made from World Class Ingot. A preferable embodiment for the continuous caster is a vertical continuous caster.

3 Claims, 1 Drawing Sheet

Comparison of Solution Heat Treat Time for Slab Cast and Ingot Source Al-Mg-Si-Cu Alloy (570°C Solutionizing Temperature)

Comparison of Solution Heat Treat Time for Slab Cast and Ingot Source Al-Mg-Si-Cu Alloy (570°C Solutionizing Temperature)
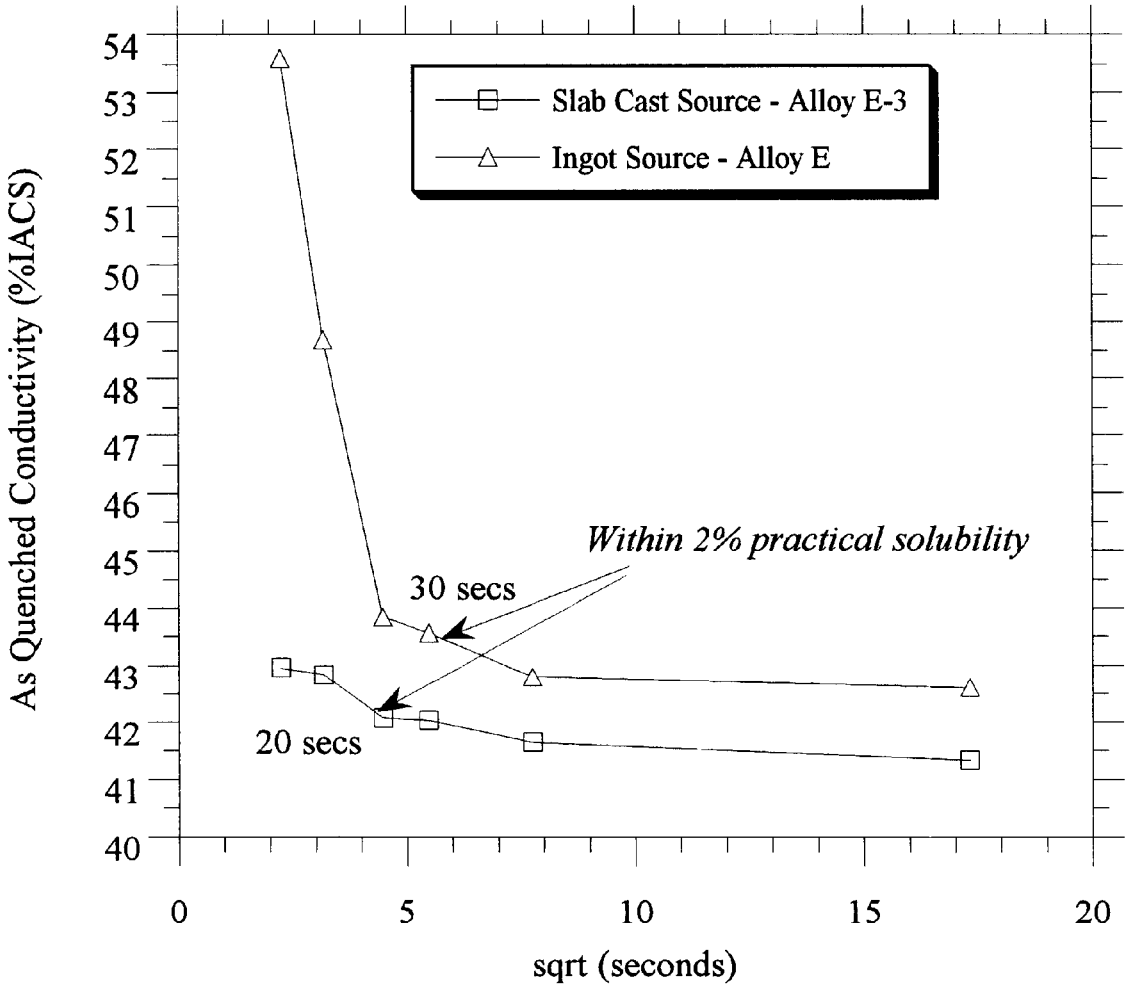

PROCESS AND PRODUCTS FOR THE CONTINUOUS CASTING OF FLAT ROLLED SHEET

FIELD OF THE INVENTION

This invention is related to the continuous casting of flat rolled products of aluminum alloys, preferably those in the 1XXX, 3XXX, 5XXX, 6XXX and 8XXX series alloys as designated by the Aluminum Association registrations, with improved surface, strength, and formability characteristics on a commercially economic basis.

BACKGROUND OF THE INVENTION

The current process for producing flat rolled aluminum sheet products for markets such as automotive, rigid container, can body and can ends, involves casting ingot, scalping the ingot, homogenization of the scalped ingot, then breaking down the ingot in hot reversing mills, followed by a continuous hot mill ultimately producing a coil of aluminum alloy. The coil either self-anneals or requires batch annealing before cold rolling to final gauge. Common alloy sheet, such as that from the 1XXX and 5XXX series alloy typically used for inventory in distributor stock, is also produced by a similar process. The advantage to this ingot based process is that it is a proven technology capable of consistently delivering the combination of strength, formability, surface quality and other product specific characteristics required by various markets.

The above recited process is inherently flawed, however, from an economic point of view due to high capital costs required in such a manufacturing process. These high capital costs swell from the apparatus required to perform the various process steps such as casting, scalping, homogenizing, and hot rolling. Recovery costs associated with scalping, end cropping and excess trimming on hot mills can cause wastage of salable alloy in any particular run of up to 25%. The ingot based process also requires high inventories to be maintained by an aluminum alloy producer and/or distributor since the process is not considered a "real time" process due to process discontinuities. These discontinuities, such as the homogenization and ingot breakdown steps, can be a major cause of mechanical property inconsistencies that are introduced into the product stream from coil to coil and even within an individual coil.

Many conventional ingot based processes capable of producing quality automotive and can sheet exceed 500 million pounds of aluminum alloy product in annual capacity. In fact, such a capacity is needed since at lower capacities manufacturers suffer a higher capital cost per pound of output making the economics difficult to maintain and/or justify. This underscores the need to solve, not just the quality problems often associated with aluminum alloy production, but more importantly, the economic dilemma. The invention hereof shines since it can help to reduce capital costs and therefore, reduce the requirement for high throughput thus making implementation of this new process more economical on a per pound basis. This may allow smaller volumes of alloy production and, therefore, smaller plants at a higher cost effectiveness.

A continuous caster, either slab or roll caster, may be inherently more cost effective simply because it does not require the homogenization, scalping, and ingot break down as part of its process. For reasons discussed below, the application of continuous casting aluminum sheet has been limited to lower solute non-heat treatable aluminum alloys for non-surface critical applications. Commercial roll casters almost exclusively produce stock for processing to foil gauges. Slab casters produce re-roll for non-surface critical sheet products such as residential building products for, as examples, aluminum siding and/or down spouts, furniture tube, and/or distributor stock. Non-surface critical applications means that the ultimate consumer is not, for example, in the food or automotive businesses where surface blemishes cause the can or, automotive stock to fail customer aesthetic standards and/or specifications.

There remain, therefore, commercial problems in the can and automotive sheet markets which the continuous casters of the prior alt have yet to resolve. These problems relate to insufficient surface quality, inadequate strength and/or formability combinations coupled to the commercial realities of a capital intense business.

In a continuous cast product, surface quality is strongly influenced by the cast surface since the scalping operation is not performed. Liquation, surface segregation and other surface heterogeneities, common to continuous caster processes, remain problematic for prior technologies.

In terms of strength and formability, thermal processing of slab cast material by traditional batch process can be a handicap due to limitations in crystallographic texture control as a consequence of the absence of a homogenization step and minimal hot rolling. Additionally, solute levels are reduced because of slow cooling from the soak temperature resulting in relatively low work hardening rates. This creates difficulty in body stock for the can industry, for example, since attaining acceptable combinations of strength and earing are near well impossible to achieve.

U.S. Pat. No. 4,238,248 addresses this problem from an historical perspective as a continuous heat treatment in combination with slab casting to achieve acceptable combinations of strength and surface characteristics. Having said that, heretofore, a continuous casting process capable of meeting the surface, strength and formability requirements of automotive, and separately can body and end stock, while producing at a manufacturing scale appropriate for market demand, has not been commercially available.

U.S. Pat. No. 5,356,495 discloses a continuous caster process. This patent does not specifically discuss the problems addressed hereunder such as combinations of strength, formability, and surface quality.

U.S. Pat. No. 4,614,224 discloses a continuous casting process but also avoids discussion of the combinations of formability, strength, and surface quality.

In a more recent effort U.S. Pat. No. 5,616,189 discloses a continuous casting process, in particular a twin belt caster, that outputs 6000 series aluminum alloys for the automotive market. Again, the combinations hereof discussed are simply ignored. The above efforts indicate that continuous caster processes are difficult to implement and still be competitive with the ingot based technology, elsewise specific discussion of the problems solved in the continuous caster product, the formability, strength, and surface integrity, would be a center piece of the disclosure.

The problems remain, however, and the invention hereof is directed to solving these problems. Accordingly, the present invention is useful for the manufacture of automotive sheet, can stock sheet, and can end stock sheet with a product that has comparable formability, strength, and surface integrity to that of World Class Ingot technology. "World Class Ingot" as used hereinafter, is a standard of sheet made from ingot with use of the most developed processes by which continuously cast aluminum alloy sheet is compared. Heretofore, typical surface characteristics and properties made from continuously cast aluminum alloy sheet could not compare to the surface characteristics and properties of product made by the ingot process.

SUMMARY OF THE INVENTION

The present invention is directed to a continuous slab casting process comprised of casting a continuous slab, hot rolling the slab through an in-line hot mill to produce a coil of hot-band. The hot-band is further processed with a combination of cold rolling and batch or continuous heat treatment to produce sheet suitable for conversion to various final products. Alloy compositions may be tailored to a designed process path to achieve certain combinations of strength, formability, and surface characteristics.

In the practice of the present invention two commercially marketable outcomes show a clear advantage over prior art continuous cast aluminum alloys. Firstly, superior surface characteristics are obtained through a better controlled and directed solidification process. This is important in order to attain a uniform surface appearance with minimum liquation which is required in applications such as exterior automotive panels, can body and end stock. This higher quality surface distinguishes aluminum alloy cast consistent with the invention hereof from common aluminum alloy distributor stock cast by other casters.

Another advantage of the inventive process derives from the use of continuous thermal treatments in the place of batch treatments. By employing continuous thermal treatment, material characteristics such as grain size, crystallographic texture, solute concentrations, and the corresponding work hardening rates are better controlled. For example, as below illustrated, in processing can body stock, the use of a directed continuous anneal prior to final cold rolling makes a work hardenable matrix that provides sufficient strength generation with less than 70% cold reduction. The continuous anneal also reduces the amount of rolling texture components and increases the random texture components prior to final cold rolling. The benefits from this improved texture and earing are more fully understood by reference to U.S. Pat. No. 5,362,341, incorporated herein by reference.

The work hardening rate which is promoted by high solute levels substantially reduces the general requirement for a strong cube texture to balance the very strong rolling texture that would otherwise be generated by the larger cold reductions required when body stock alloys are batch annealed. The resulting continuous annealed product is fabricated with less cold reduction than conventionally batch annealed can sheet and thereby exhibits excellent earing while achieving an improved formability and strength.

The present invention also indicates that there is improvement from the finer constituent particle size generated relative to that of the conventional ingot process of manufacture. The finer constituent provides superior bending and hemming characteristics as will be further described below. The increased number of constituent particles refines grain size in low Mn containing heat treatable alloys which reduces orange peel tendencies. As those skilled in this alt know, bending performance and surface appearance after deformation are very important characteristics for aluminum alloy use for auto body sheet applications.

Commercial viability of this continuous caster process hinges on reducing the fabrication costs thereof In the production of distributor sheet alloys, this goal can be further achieved by the process of the present invention by hot rolling directly to final gauge. The hot rolled material would then be fully annealed to produce the O type temper or stabilized to produce the H3x temper. The practice of the present invention facilitates achievement of these tempers due to the consistency of the hot mill entry temperature.

The aluminum alloys contemplated as within the scope of this invention are commonly referred to as the 1000, 3000, 5000, 6000, and 8000 series aluminum alloys. While the overwhelmingly major constituent of any of the alloys hereof is aluminum there are major constituents that impact the formability, strength and surface quality of the resultant alloys. For example, the 1000 series may have a Si and Fe combined concentration of up to 1.00 weight percent. The 3000 series may have major constituents in weight percent of Mn of up to 1.5, Cr of up to 0.40, Mg of up to 1.5, Si of up to 1.8, Fe of up to 0.8, and at times Cu of up to 0.30. The 5000 series may have major constituents in weight percent of Mg of up to 5.6, Mn of up to 0.8, Cu of up to 0.35, Fe of up to 0.50, Si of up to 0.40, Zn of up to 2.8 and Cr of up to 0.35 The 6000 series may have major constituents in weight percent of Mg of up to 1.4, Mn of up to 1.1, Cu of up to 1.1, Fe of up to 1.0, Si of up to 1.5, Zn as high as 2.4, and Cr of up to 0.40. The 7000 series alloys may have major constituents of Mg of up to 3.4, Zn as high as 9.7, Cu of up to 2.6, Mn of up to 1.5, Si as high as 0.6, Fe as high as 1,4, sometimes Sc and Ag may be added of up to 0.7, and Cr of up to 0.35. The 8000 series may have Zn up to 1.8, Mn up to 1.0, Si up to 1.9, Fe as high as 8.9, with minor amounts of Mg and Cu of up to 1.8. Incidental impurities may be Zr, Ti, V, Hf, and from time to time Fe and Si.

Those skilled in this art can appreciate that slab casting can be affected in many spatial orientations. As common examples, either 180° horizontal or 180° vertical. For the purposes of the present invention it is preferred that the spatial orientation be 180° vertical, or as referenced hereafter, a vertical caster. It is contemplated however, that such an orientation is not a requirement for the disclosed invention and that any spatial orientation would be sufficient to effect the ends of the present invention.

BRIEF DESCRIPTION OF THE DRAWING

The FIGURE shows a comparison of solution heat treat time for slab cast and ingot source Al—Mg—Si—Cu alloy.

DETAILED DESCRIPTION OF PREFERRED EMBODIMENTS

The process described herein below comprises several specific embodiments of the inventive process described herein above. The following specific embodiments are intended to be additional teachings of the present invention and are not intended as limitations thereof.

That the teachings hereof can be applied to the several different product types that have been before discussed, will become apparent by the following disclosures. Suffice it to say that the generic invention of the vertical caster of the present invention comprises species selected from can body sheet, automotive sheet, distributor sheet, and can end stock sheet as end products of the vertical caster process.

Can Body Sheet

The can body sheet composition comprises about 0.8 to 1.5 wt. % magnesium, about 0.7 to 1.5 wt. % manganese, about 0.05 to 0.50 wt. % copper, 0.2 to 0.7 wt. % iron 0.10 to 0.40 wt. % silicon and the balance being aluminum and incidental elements and impurities. Of the castings which can be made under the can body sheet composition the continuous cast thickness can be between about 5 mm to 25 mm, preferably between about 17 to 23 mm. The continuously cast slab is directly hot rolled entering the hot mill at a temperature within the range of approximately 370° to 510° C., preferably within the range of approximately 400° to 450° C. A total hot reduction within the range of about 50 to 90%, preferably within the range of about 78 to 85% of the original casting, is taken exiting the hot mill within a temperature range of about 200° to 400° C., preferably about 310° to 370° C. The alloy is cold reduced within about 30 to 90% of the hot band thickness, and preferably about 50 to 80%. The intermediate continuous anneal temperature was about 525° to 580° C., preferably about 545° to 575° C. and followed by a quench. As those skilled in this art can appreciate the intermediate anneal temperature was maintained for a sufficient time to recrystallize the microstructure. The quenched product is subsequently cold reduced again from about 25 to 80%, preferably from about 50 to 70%. Optionally, the now reduced can body sheet is self stabilized by exiting at an appropriate temperature, or batch stabilized between about 95° to 200° C., preferably about 110° to 150° C.

The final can body sheet physical properties were as follows. The post bake yield strength in MPa for the caster of the present invention was 258 as compared to World Class Ingot of 262. The 45° Earing in percent for the caster was 2.7 as compared to World Class Ingot of 3.0. The maximum strength loss in can sidewall due to paint bake was 12.4% for the caster compared to 24.2% for the World Class Ingot, which results in a can with a stronger sidewall. While these results do not show a marked overall improvement when compared to World Class Ingot, it is here emphasized that the invention lies in providing can body sheet which either approaches or betters the best properties on the market for can body sheet by producing that can body sheet with a continuous casting process. The above remarkable results compare very favorably to can body sheet made from World Class Ingot, while realizing the economic and commercial advantages of the continuous slab casting process. It is noteworthy that the results hereof are compared to ingot instead of other continuous caster results, since typical prior alt continuous caster results simply do not measure up against the World Class Ingot results.

As an example of the manufacture of can body sheet, two alloys were provided with the compositions shown in Table 1. Both alloys were cast continuously as a 25 mm strip and water quenched to room temperature. The slabs were rapidly re-heated to 510° C. in less than five minutes and hot rolled in two passes to a thickness of 2.8 mm. The 1.10 wt. % Mn alloy, alloy A, was hot rolled targeting an exit temperature of 307° C., while the low Mn containing alloy, alloy B, was hot rolled targeting hot mill exit temperatures of 288° C. and 343° C. After hot rolling, each lot was slow cooled at approximately 10° C./hr from the hot rolling temperature. All material was cold rolled to an intermediate thickness and flash annealed, holding at a temperature of 510° C. for a time of 10 seconds. The material was subsequently cold rolled 54%, 57% or 60%, and stabilized for two hours at 135° F. (57° C.). The yield strengths after stabilization and after an additional thermal treatment of 20 minutes at 204° C. to simulate a paint curing operation, and 45° earing results are shown in Table 2. The results indicate that a product with acceptable post bake yield strengths and 45° earing can be produced within the composition and processing ranges specified, however, the preferred product is produced with a higher exit temperature in combination with lower Mn and higher Cu. Alloy B-1 was subsequently used to successfully draw and iron 500 cans which included necking and flanging. Sidewall strength was measured in the axial direction of the can parallel to the rolling direction after the drawing and ironing operation and after a thermal treatment of 20 minutes at 204° C. and compared with World Class Ingot. The results in Table 2 reveal that despite a lower strength after drawing and ironing, the continuous cast product had a higher retained strength after the thermal treatment.

TABLE 1

| | Si | Fe | Cu | Mn | Mg |
|---|---|---|---|---|---|
| Alloy A | 0.20 | 0.49 | 0.13 | 1.10 | 1.16 |
| Alloy B | 0.24 | 0.51 | 0.19 | 0.90 | 1.13 |

TABLE 2

| Alloy | Hot Mill Exit Temperature (° C.) | % Final Cold Reduction | 0.2% Yield Strength (MPa) | 0.2% Post Bake Yield Strength (MPa) | % 45° Earing | Formed Sidewall Yield Strength (MPa) | Heat Treated Sidewall Yield Strength (MPa) |
|---|---|---|---|---|---|---|---|
| A | 307 | 54 | 265 | 250 | 3.2 | — | — |
| B-1 | 343 | 57 | 261 | 258 | 2.7 | 338 | 296 |
| B-2 | 343 | 60 | 261 | 256 | 2.9 | — | — |
| B-3 | 288 | 60 | 264 | 262 | 3.4 | — | — |
| World Class | — | — | — | 262 | 3.0 | 375 | 288 |

Automotive Sheet

The automotive sheet composition comprises, about 0.2 to 1.5 wt. % silicon, about 0.3 to 1.5 wt. % magnesium, optionally about 0.05 to 0.9 wt. % manganese, about 0.05 to 1.2 wt. % copper, typically less than 0.30 wt. % Fe with the balance being aluminum and incidental elements and impurities. Of the castings made under the automotive sheet composition the continuous cast thickness can be between about 5 to 25 mm, preferably between about 9 to 23 mm. The continuously cast slab is directly hot rolled entering the hot mill exit temperature within a range of about 200° to 400° C., preferably about 230° to 290° C. A total hot reduction within the range of about 50 to 90%, preferably within the range of about 78 to 85% of the original casting, is taken exiting the hot mill within a temperature range of about 200° to 400° C., preferably about 230° to 290° C. An optional intermediate batch anneal can be employed with a soak temperature of about 325° to 510° C., preferably about 340° to 440° C. As those skilled in this art can appreciate the intermediate batch anneal temperature was maintained for a sufficient time to recrystallize the microstructure. The optionally annealed product was subsequently cold reduced from the previous hot band thickness from about 25 to 90%, preferably from about 35 to 65%. The cold reduced product is then solution heat treated from about 525° to 580° C., preferably about 545° to 575° C. for a time known to those skilled in this art needed to dissolve a sufficient amount of soluble second phase particles required to achieve desired properties and subsequently quenched in a manner needed to retain a supersaturated solid solution.

The final relevant and revealing automotive sheet physical properties were as follows. The minimum bend radius (radius/thickness) after 10% pre-stretch for the vertical caster was 0.45 longitudinal and 0.79 transverse as compared to World Class Ingot of 0.60 longitudinal and 0.81 transverse, respectively. This composition included elements from Al—Mg—Si—Cu alloy.

For a composition representative of an Al—Mg—Si alloy, the continuous caster exhibited a minimum bend radius after a 10% pre-stretch of 0.55 longitudinal and 0.55 transverse as compared to a World Class Ingot of 1.00 longitudinal and 0.55 transverse.

Again as above, it is noteworthy that the results hereof are compared to ingot instead of other continuous caster results, since typical prior all continuous caster results simply do not measure up against the World Class Ingot results.

Two alloys were provided with the compositions shown in Table 3. Both alloys were cast continuously as a 25 mm strip and water quenched to room temperature. The slabs were rapidly re-heated to 482° C. and hot rolled in two passes to a target thickness of either 3.0 or 6.3 mm and exiting the hot mill at a target temperature of either 260° C. or 320° C. Selected lots were then batch annealed. All material was cold rolled either 30 or 68% followed by a solutionizing treatment. The results shown in Table 4 indicate that all continuous caster source material met transverse tensile properties typical of World Class ingot material, however, upon evaluation of other aspects such as grain size, anisotropy and formability preferred processing paths become apparent.

TABLE 3

| | Si | Fe | Cu | Mn | Mg |
|---|---|---|---|---|---|
| Alloy D | 1.27 | 0.15 | 0.07 | 0.08 | 0.59 |
| Alloy E | 0.89 | 0.23 | 0.58 | 0.20 | 0.66 |

TABLE 4

| Alloy | Hot Band Thickness (mm) | Hot Mill Exit Temp (° C.) | HLG[1] Anneal | Cold Rdx | Yield Strength (MPa) | Tensile Strength (MPa) | % Total Elongation |
|---|---|---|---|---|---|---|---|
| D-1 | 6.3 | 329 | none | 70 | 151 | 272 | 28.3 |
| D-2 | 6.3 | 263 | none | 66 | 154 | 278 | 29.3 |
| D-3 | 3.0 | 306 | none | 68 | 149 | 270 | 28.8 |
| D-4 | 3.0 | 264 | none | 66 | 153 | 271 | 26.3 |
| D-5 | 3.0 | 264 | none | 30 | 150 | 272 | 28.0 |
| D-6 | 3.0 | 268 | yes | 66 | 154 | 274 | 28.0 |
| Ingot-D | — | — | — | — | 138 | 253 | 26.0 |
| E-1 | 6.3 | 334 | none | 68 | 168 | 308 | 26.5 |
| E-2 | 6.3 | 262 | none | 70 | 171 | 316 | 25.5 |
| E-3 | 3.0 | 250 | yes | 72 | 163 | 298 | 25.3 |
| E-4 | 3.0 | 257 | none | 71 | 161 | 299 | 25.5 |
| Ingot-E | — | — | — | — | 159 | 290 | 25.0 |

[1]HLG = Hot line gauge or hot rolled thickness

The results shown in Table 5 indicate that the hot mill exit temperature will directly impact grain size when hot reductions of approximately 75% are used (D-1, E-1, D-2, E-2). But at increased hot reductions, of approximately 88% (D-3, D-4, D-5), exit temperature had a reduced influence on grain size when combined with a larger cold reduction. However, an increase in planar anisotropy occurred. It was found that a balance between grain size and planar anisotropy could be optimized by exiting the hot mill at a temperature low enough to retain some stored energy, a temperature less than approximately 285° C. in combination with a lower cold reduction, in the range of 40%. This is represented by alloy D-5. This provides an additional cost savings benefit by enabling the fabrication of sheet with a single cold rolling operation. Typically, reductions greater than about 50% require multiple cold mill passes, which when performed on a single stand cold mill can increase flow time and production costs.

TABLE 5

| Alloy | ASTM Grain Size | Planar Anisotropy (Δr) |
|---|---|---|
| D-1 | 2.0–3.0 | 0.053 |
| E-1 | 2.0–3.0 | 0.071 |
| D-2 | 6.0–6.5 | 0.111 |
| E-2 | 5.0–5.5 | 0.004 |
| D-3 | 6.5–7.0 | 0.232 |
| D-4 | 6.5–7.0 | 0.291 |
| D-5 | 6.0–6.5 | 0.091 |

Casting at a slab thickness of approximately 25 mm and greater requires larger hot and cold reductions to achieve typical body panel sheet thicknesses, in the range of 1.0 mm. For this casting and processing condition, it was found that annealing after hot rolling could be used and may have beneficial influence on formability, as indicated by the Limiting Dome Height (LDH) test, and on final planar anisotropy. See Table 6. The LDH test is a common simulative formability test used by those involved with automotive sheet stamping.

TABLE 6

| Alloy | ASTM Grain Size | Planar Anisotropy (Δr) | LDH[1] (mm) |
|---|---|---|---|
| D-6 | 6.5–7.0 | 0.192 | 24.6 |
| D-4 | 6.5–7.0 | 0.291 | 24.1 |
| E-3 | 5.5–6.0 | 0.107 | 24.1 |
| E-4 | 5.5–6.0 | −0.069 | 23.4 |

[1]Average of longitudinal and transverse test directions

Alloys processed demonstrated very good bending characteristics, overall showing improvement over the ingot counterpart which may be in part due to the finer constituent particles. See Table 7. Additionally alloy D-6 was successfully flat hemmed in both the rolling and transverse directions. Hemming is an operation in which outer panels are attached to inner panels, i.e., hood outers to inners. Automotive manufacturers desire an alloy which is flat hem capable since it simplifies tooling design and provides a sharper look.

TABLE 7

| Alloy | Guided Bend (r/t) Longitudinal | Guided Bend (r/t) Transverse |
|---|---|---|
| D-6 | 0.55 | 0.55 |
| D-ingot source | 1.00 | 0.55 |
| E-3 | 0.45 | 0.79 |
| E-Ingot source | 0.60 | 0.81 |

In addition to the formability of the product, it was found that a slab cast product when subjected to a similar downstream processing path as an ingot source product could be solutionized more rapidly than its ingot counterpart. The FIGURE compares the as-quenched conductivity of 0.9 mm ingot source and slab cast source material which were given an anneal after hot rolling. As shown, the conductivity of the slab cast source material achieves a value within 2% of its practical solubility in 33% less time than the ingot material. Practical solubility is defined here as the as-quenched conductivity after five minutes at the solutionizing temperature. Further reductions in solutionizing time would be realized by use of the preferred processing path described earlier in which reduced hot rolling temperatures are maintained lower than 285° C. and no anneal after hot rolling is used.

Endstock Sheet

The endstock sheet composition comprises, about 3.0 to 5.0 wt. % magnesium, about 0.05 to 0.6 wt. % manganese, about 0.05 to 0.5 wt. % copper, typically less than 0.40 wt. % iron, typically less than 0.30 wt. % Si, the balance being aluminum and incidental elements and impurities. Of the castings which can be made under the endstock sheet composition the continuous cast thickness can be between about to 25 mm, preferably between about 17 to 23 mm. The continuously cast slab is directly hot rolled entering the hot mill at a temperature within the range of approximately 370° to 510° C., preferably within the range of approximately 400° to 450° C. A total hot reduction within the range of about 50 to 90%, preferably within the range of about 78 to 85% of the original casting, is taken exiting the hot mill within a temperature range of about 200° to 400° C., preferably about 230° to 290° C. An optional intermediate anneal temperature was about 325° to 510° C., preferably about 340° to 440° C. As those skilled in this art can appreciate the intermediate anneal and quench temperature was maintained for a sufficient time to recrystallize the microstructure. The optionally annealed product was subsequently cold reduced from the previous hot band thickness from about 25 to 90%, preferably from about 30 to 60%. A second intermediate anneal was performed at about 325° to 510° C., preferably 340° to 440° C. for a sufficient time to recrystallize. The product of the second anneal was then cold reduced again by about 70 to 95%, preferably from about 80 to 90%. This final reduction can then be optionally self-stabilized by exiting at an appropriate temperature or stabilized by heating and soaking the metal for about 2 hours at about 95° to 200° C., preferably 110° to about 150° C.

The relevant and revealing physical characteristics for endstock sheet are yield strength, 45° earing the 90° bend radius cracking severity test rated on a scale of I to 10 with 10 equaling severe cracking. The above processed endstock sheet exhibited a stabilized yield strength of 341 MPa, 45° earing 5.9% and a bend rating of 5.5 in the longitudinal and transverse directions. This is compared to the World Class Ingot endstock having stabilized yield strength of 352 MPa, 45° earing of 5.2%, and a bend rating of 6.5 in the longitudinal and 9.0 in the transverse directions.

An alloy with the composition shown in Table 8 was provided. The alloy was cast at 25 mm and water quenched to room temperature. The alloy was rapidly re-heated to 482° C. and hot rolled in two passes to a thickness of 3.3 mm, exiting at a temperature of 343° C. and slow cooled 10 IC/hr to room temperature. Part of the hot rolled material was given a 92.5% cold reduction, typical of ingot processing while part was cold rolled to 0.048 inch, flash or batch annealed and cold rolled approximately 81% to final thickness. The flash anneal consisted of rapidly heating the sheet to a temperature of 900° F. (482° C.) and holding for a time of 20 seconds. The batch anneal consisted of a 10 IC/hr heat-up to 650° F. (343° C.), holding for two hours and cooling to room temperature at 10° F./hr (5.5° C./hr). All cold rolled material was stabilized for 2 hours at 124° C. As indicated by the results, an acceptable product for end stock applications can be produced with the use of an intermediate anneal. This is due to the use of low final reduction while still achieving an acceptable strength. Additionally, the use of a low final reduction resulted in superior bending performance compared to ingot while maintaining an earing level acceptable for shell manufacture and seaming operations. This was demonstrated by the successful stamping and conversion of 500 end shells from alloys C-2 and C-3. The results further indicate that use of a flash anneal may provide additional strength and formability advantages.

TABLE 8

| | Si | Fe | Cu | Mn | Mg |
|---|---|---|---|---|---|
| Alloy C | 0.08 | 0.18 | 0.04 | 0.25 | 4.63 |

TABLE 9

| Alloy | Intermediate Anneal | % Final Cold Reduction | 0.2% Yield Strength (MPa) | Transverse Bend Rating[1] (0.2 mm Radius) | % 45° Earing |
|---|---|---|---|---|---|
| C-1 | None | 92.5 | 352 | 9.5 | 6.8 |
| C-2 | Continuous | 81.0 | 341 | 5.5 | 5.9 |
| C-3 | Batch | 80.0 | 333 | 6.0 | 5.9 |
| Ingot | None | 92.5 | 352 | 9.0 | 5.2 |

[1]Visual ranking of cracking severity according to following scale:
1 = No evidence of cracking
2 = No evidence of cracking with surface roughening
3 = <5 "shallow" cracks only
4 = >5 "shallow" cracks only
5 = 1 or 2 "deep" cracks + "shallow" cracks
6 = 3 to 6 "deep" cracks + "shallow" cracks, or many "wide" "shallow" cracks
7 = >6 "deep" cracks + "shallow" cracks, or <6 "deep" cracks + many "wide" "shallow" cracks
8 = "deep" cracks over approximately 10%–25% of the specimen
9 = "deep" cracks over approximately 25%–50% of the specimen
10 = "deep" cracks over >50% of the specimen

We claim:

1. A method comprising casting an aluminum alloy as a continuous cast slab to a thickness of 17 to 25 mm, hot rolling said slab in a temperature range from 370° to 510° C., reducing said slab to within the range of 50 to 90% of its original thickness to sheet thickness said sheet exiting the hot roll within a temperature range of about 200° to 400° C., cold reducing said sheet within 30 to 90% of the hot band thickness, subjected to an intermediate continuous anneal at 525° to 580° C. sufficient to recrystallize the microstructure followed by a quench to make a quenched product, cold reducing said quenched product by 25 to 80% and batch stabilized between 95° to 200° C. to make a batch stabilized sheet product wherein said batch stabilized sheet product consists essentially of an aluminum alloy composition of 0.8 to 1.5 wt % magnesium, 0.7 to 1.5 wt % manganese, 0.05 to 0.50 wt % copper, 0.2 to 0.7 wt % iron, 0.10 to 0.40 wt % silicon and the balance being aluminum and incidental elements and impurities wherein said product comprises a bake yield strength of at least 258 Mpa, a 45° earing in percent of no more than 2.7, and a maximum strength loss of no more than 12.4% due to paint bake.

2. A method comprising casting an aluminum alloy as a continuous cast slab to a thickness of 9 to 23 mm, hot rolling said slab in a temperature range from 200° to 400° C., hot reducing said slab to within the range of about 50 to 90%, said slab exiting the hot mill in a temperature range between 230° to 290° C. then subjected to an optional intermediate batch anneal with a soak temperature of about 325° to 510° C. to effect a recrystallization, cold reducing said slab from the hot band thickness from about 25 to 90% making a sheet product, heat treating said sheet solution from about 525° to 580° C. sufficiently long to dissolve a portion or more of soluble second phase particles and subsequently quenching to retain a supersaturated solid solution wherein said sheet consists essentially of 0.2 to 1.5 wt % silicon, about 0.3 to 1.5 wt % magnesium, optionally about 0.05 to 0.9 wt % manganese, about 0.05 to 1.2 wt % copper, less than 0.30 wt % iron with the balance being aluminum and incidental elements and impurities wherein said sheet has a minimum bend radius after a 10% pre-stretch is 0.45 longitudinal and 0.79 transverse.

3. A method comprising casting an aluminum alloy as a continuous cast slab to a thickness of 17 to 23 mm, hot rolling said slab in a temperature range from 370° to 510° C., reducing said slab to within the range of 50 to 90% of its original thickness to sheet thickness, said sheet exiting the hot roll within a temperature range of about 200° to 400° C., said sheet optionally provided an intermediate anneal within the temperature range of 325° to 510° C. cold reducing said sheet from about 25 to 90%, recrystallizing said sheet optionally self-stabilizing said sheet by heating and soaking said sheet for about 2 hours at 95° to 200° C. wherein said sheet consists essentially of 3.0 to 5.0 wt % magnesium, about 0.05 to 0.6 wt % manganese, about 0.05 to 0.5 wt % copper, less than 0.40 wt % iron less than 0.30 wt % Si the balance being aluminum and incidental elements and impurities wherein said sheet has a stabilized yield strength of 341 MPa, a 45° earing of no more than 5.9%, and a bend rating of 5.5.

* * * * *